US009000676B2

(12) United States Patent
Radermacher et al.

(10) Patent No.: US 9,000,676 B2
(45) Date of Patent: Apr. 7, 2015

(54) LED CIRCUIT ARRANGEMENT

(75) Inventors: Harald Josef Günther Radermacher, Aachen (DE); Toni Lopez, Kelmis (BE); Matthias Wendt, Würselen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/879,156

(22) PCT Filed: Oct. 13, 2011

(86) PCT No.: PCT/IB2011/054545

§ 371 (c)(1),
(2), (4) Date: Apr. 12, 2013

(87) PCT Pub. No.: WO2012/052893

PCT Pub. Date: Apr. 26, 2012

(65) Prior Publication Data

US 2013/0200812 A1 Aug. 8, 2013

(30) Foreign Application Priority Data

Oct. 19, 2010 (EP) ..... 10188037
Dec. 1, 2010 (EP) ..... 10193359

(51) Int. Cl.
*H05B 33/08* (2006.01)

(52) U.S. Cl.
CPC ..... *H05B 33/08* (2013.01); *H05B 33/0824* (2013.01)

(58) Field of Classification Search
CPC ..... H05B 33/08; H05B 37/02; H05B 41/24; F21S 4/001; F21S 4/00; Y02B 20/22
USPC ..... 315/224, 291, 307, 312, 185 R, 185 S, 315/209 R, 200 R, 248
See application file for complete search history.

(56) References Cited

U.S. PATENT DOCUMENTS

| | | | | |
|---|---|---|---|---|
| 3,784,844 | A * | 1/1974 | McGrogan, Jr. | 327/538 |
| 7,468,723 | B1 | 12/2008 | Collins | |
| 7,557,462 | B2 | 7/2009 | Shie | |
| 8,493,000 | B2 * | 7/2013 | Jungwirth | 315/307 |
| 2009/0072764 | A1 * | 3/2009 | Kitagawa et al. | 315/320 |
| 2010/0091807 | A1 * | 4/2010 | Deppe et al. | 372/38.04 |
| 2010/0109537 | A1 * | 5/2010 | Nishino et al. | 315/185 R |

FOREIGN PATENT DOCUMENTS

| | | | |
|---|---|---|---|
| CN | 1816234 | A | 8/2006 |
| DE | 10159765 | A1 | 7/2003 |

(Continued)

*Primary Examiner* — Minh D A
(74) *Attorney, Agent, or Firm* — Yuliya Mathis

(57) ABSTRACT

An arrangement includes a voltage input, a reactive element connected in series with the voltage input, and an LED light source. The LED light source includes a first LED unit and a second LED unit, each having at least one LED, a controllable switching device to connect the LED units with the reactive element in a low voltage mode and a high voltage mode, and a control unit. The LED light source has a first, higher, forward voltage in the low voltage mode and a second, lower, forward voltage in the high voltage mode. The control unit controls the current through the LED light source by setting the switching device to the low voltage mode when the current, supplied to the LED light source, corresponds to a first threshold value, and by setting the switching device to the high voltage mode when the current corresponds to a second threshold value.

20 Claims, 4 Drawing Sheets

(56) References Cited

FOREIGN PATENT DOCUMENTS

| | | | |
|---|---|---|---|
| DE | 102005033897 | A1 | 1/2007 |
| DE | 102006024607 | A1 | 11/2007 |
| EP | 695112 | A1 | 1/1996 |
| WO | 2007129131 | A1 | 11/2007 |

* cited by examiner

LED CIRCUIT ARRANGEMENT

FIELD OF THE INVENTION

The present invention relates to a LED circuit arrangement, a LED light source and a method of operating an LED circuit arrangement. Specifically, the present invention relates to driving an LED circuit arrangement at an operating voltage while providing a safe and cost-efficient setup.

BACKGROUND OF THE INVENTION

Light emitting diodes (LEDs) are used for a multitude of applications, including in particular signaling and, nowadays to an increasing extent, general illumination applications. Depending on the application and the type of LED used, various designs of driving circuits for LEDs exist. Due to the exponential dependence between operating current and voltage, similarly to other diodes, LEDs are typically driven with a constant current power-supply unit or driving circuit. Most simply, the driving circuit may consist of a series resistor to limit the maximum current delivered to the light emitting diode in case of a variation of the operating voltage. Certainly, due to the relatively high losses, such an arrangement may be particularly unsuitable for lighting applications, e.g. in combination with high-power LEDs. Besides the above mentioned simple driving circuit with a series resistor, other driving circuits exist in the art. However, such circuits typically are elaborate and thus costly. Additionally, the circuit design in most cases needs to be adapted to the type and number of LEDs used, providing limited scalability. Thus, in particular for the emerging use of LEDs in general illumination applications, such circuits may be unsuitable.

Therefore, it is an object of the present invention to provide an LED circuit arrangement enabling efficient operation of an LED light source, i.e. with reduced loss, and having a cost-optimized circuit design.

SUMMARY OF THE INVENTION

The object is achieved by a LED circuit arrangement according to claim 1, a LED light source according to claim 13 and a method of operating a LED light source according to claim 14. Dependent claims relate to preferred embodiments of the invention.

The basic idea of the invention is to provide a LED circuit arrangement, wherein a LED light source is operable in a low voltage mode and a high voltage mode in dependence on a current level to provide control of the current through the LED light source. The present invention thus advantageously enables driving the LED light source with a simple and cost-efficient voltage source, such as a typical power supply unit.

The LED circuit arrangement according to the invention comprises at least a voltage input, adapted to provide an operating voltage during operation, a reactive element, connected in series with said voltage input, and at least one LED light source. The LED light source comprises a first and a second LED unit, each having at least one light emitting diode (LED), controllable switching means to connect said LED unit with said reactive element in a low voltage mode and a high voltage mode and a control unit. In said low voltage mode, the LED light source shows a first forward voltage. In the high voltage mode, the LED light source shows a second forward voltage, higher than said first forward voltage. The control unit is configured to set said switching means to said low voltage mode when an operating current supplied to said LED light source corresponds to a first current threshold value and to set said switching means to said high voltage mode when said supplied current corresponds to a second current threshold value.

As mentioned above, the inventive LED circuit arrangement comprises a voltage input, adapted to provide an operating voltage to said LED light source during operation. The voltage input may thus comprise a suitable voltage-controlled power supply unit or may be adapted to be connected to a suitable voltage source, e.g. a suitable external power supply. The internal/external power supply may be adapted to provide a nominal output voltage of 3.3V, 5V, 12V, 13.8V, 24V or 48V for example and can be charged to a defined maximum current. Such a power supply may e.g. be a simple mains-connectable transformer with a rectifier or a battery. Optionally, said power supply may comprise filter circuitry. The voltage input may thus e.g. comprise two electric terminals, such as solder pads, bond wire pads, or any suitable conductor or plug for connection to power.

Although according to the present invention, the term "operating voltage" refers to a unipolar voltage, e.g a DC voltage, the inventive LED circuit arrangement allows a certain variation in voltage, such as a voltage "ripple" of a DC voltage, provided from a mains line via a typical non-stabilized rectifier. The voltage input may certainly comprise additional electric or mechanical components, for example, in case the circuit arrangement is provided to be removed from the voltage source, a corresponding separable electrical connector.

The reactive element is connected in series with the voltage input to provide the LED unit with "reactive power". The reactive element may thus be arranged between the voltage input and the LED light source, but may alternatively or in part be integral with one of the aforesaid components, depending on the respective application. The reactive element may e.g. be arranged between one of the electric terminals of the voltage input and a corresponding terminal of the LED light source.

The reactive element may be any suitable kind of energy storage, such as a magnetic field energy storage, e.g. an inductor, a coupled inductor, a transformer, a suitable conductor or any type of electric component, providing inductive properties. Preferably, however, the reactive element is an inductor, e.g. a coil of suitable type and inductance.

The LED circuit arrangement according to the invention further comprises said LED light source having a first and a second LED unit. The first and second LED unit each comprise at least one light emitting diode, which in terms of the present invention may comprise any type of solid state light source, such as an inorganic LED, an organic LED or a solid state laser, e.g. a laser diode.

For general lighting applications, the LED unit may preferably comprise at least one high-power LED, i.e. having a luminous flux of more than 1 lm. Preferably, said high-power LED provides a luminous flux of more than 20 lm, most preferably more than 50 lm. For retrofit applications, it is especially preferred that the total flux of the LED light source is in the range of 300 lm to 10,000 lm.

Most preferably, the light emitting diodes of said first and/or second LED units are formed integrally on a single semiconductor die or substrate to provide a compact setup.

The LED units may certainly comprise further electric or electronic components such as a driver unit, e.g. to set the brightness and or color, a smoothing state or a filter capacitor. Each LED unit may comprise more than one LED, for example to increase the luminous flux of the LED light source or in applications where color-control of the emitted light is desired, e.g. using RGB LEDs.

According to the invention, the LED light source further comprises controllable switching means to connect the first and the second LED unit with the reactive element in a low voltage mode and a high voltage mode. The switching means may thus be of any suitable type to enable that the LED units are connectable with said reactive element in the low voltage mode or the high voltage mode. Certainly, further electric circuitry may be present to realize said low and high voltage modes. However, the switching means enable controlling the respective mode of operation, i.e. low and high voltage mode, respectively. The switching means should preferably be adapted to the electrical specifications of the application in terms of maximum voltage and current, but also regarding switching frequency, i.e. should be set recurrently to the low voltage mode and the high voltage mode. Most preferably, the switching means are adapted in combination with the reactive element and the operating voltage to provide a switching frequency higher than 20 kHz.

The switching means may comprise one or more suitable electric or electronic switching devices, for example one or more transistors, in particular one or more bipolar and/or field effect transistors. Preferably, the switching means comprise one or more MOSFETs, which are particularly advantageous in terms of switching current and frequency range.

The switching means are controlled by said control unit over a suitable wired or wireless control connection. The control unit is configured to control said switching means to the low voltage mode when an operating current, supplied to said LED light source, corresponds to said first threshold value and to control said switching means to the high voltage mode when said supplied current corresponds to said second threshold value. The control unit is thus adapted to control the switching means in dependence on the current level during operation, i.e. the current through the LED light source, e.g. when an operating voltage is provided to the circuit arrangement at the voltage input.

The control unit may be of any suitable type enabling control of the switching means as described above. The control unit may therefore comprise discrete and/or integrated electric or electronic components, a microprocessor and/or a computer unit, e.g. with suitable programming. Preferably, the control unit is integrated with the switching means to provide a most compact setup.

The first and second threshold values may be fixed set-point values, e.g. factory-set according to the respective application, for example according to the type and current consumption of the LEDs of said first and second LED unit. Alternatively, the first and second threshold values may be variable, e.g. stored in a suitable memory. In this case, a user interface may be provided to allow the user or installer to set the threshold values. Alternatively or additionally, the threshold values may be set or influenced by a feedback unit, e.g. measuring the luminous flux of the LED units during operation.

According to the invention, the first and second threshold values refer to defined current levels, so that the control unit may set the operating mode of the switching means accordingly to provide a current-based control. Thus, the mode of operation of the switching means is set according to the level of the operating current. The control unit controls the switching means to operate in the low voltage mode when the operating current corresponds to said first threshold value. Accordingly, the switching means are controlled to operate in the high voltage mode when the supplied current corresponds to said second threshold value.

The two modes of operation of the switching means differ from each other in the forward voltage of the LED light source. The term "forward voltage of the LED light source" in the present context refers to the overall voltage drop across the LED light source when a voltage is applied to the LED light source, e.g. over the voltage input.

The overall voltage drop according to the first forward voltage, thus in the low voltage mode, is lower than the voltage drop according to the second forward voltage, i.e. in the high voltage mode.

Assuming a relatively constant or slowly changing operating voltage, the different voltage drop of the LED light source advantageously allows controlling the current, since the series-reactive element decouples to some degree the operating voltage from the voltage across the LED units and provides a current to the LED light source in dependence on the respective voltage level. For example, in the low voltage mode, the reactive element may be configured to operate in a charging mode, i.e. to store energy, resulting in an increase of the current. In the high voltage mode, the reactive element may accordingly be operated in a discharging mode, so that the current successively decreases. Thus, the inventive circuit arrangement provides regulation of the current through the first and second LED units within a control margin according to the first and second threshold values. It is thus possible to operate the LED circuit arrangement with a voltage source instead of a fixed current source or elaborate current controlling circuitry.

The LED circuit arrangement and/or the LED light source may certainly comprise further components, such as a housing, one or more sockets, a smoothing stage, a flicker filter circuit and/or further control circuitry, e.g. to set the color of the emitted light in the case of at least one RGB LED unit. Additionally, a communication interface may preferably be present to receive control commands and/or report status information, e.g. from a wall-mounted dimmer via a 0-10 V control signal, Dali, DMX, Ethernet, WLAN, Zigbee or the like.

As mentioned above, the first and second threshold values may be set in accordance with the application and in particular in accordance with the current levels of the LED units. According to a preferred embodiment of the invention, the current corresponding to the first threshold value is less than the current corresponding to second threshold value.

In particular in the latter case, the control unit is preferably configured to control said switching means to operate in the low voltage mode when the operating current is less than and/or equal to said first threshold value. Most preferably, the control unit is additionally configured to control said switching means to operate in the high voltage mode when the operating current is higher than and/or equal to said second threshold value.

Preferably, in the low voltage mode, the forward voltage of said LED light source, i.e. the first forward voltage, is less than said operating voltage. Most preferably, the forward voltage of said LED light source in the high voltage mode, i.e. the second forward voltage, is higher than the operating voltage.

The present embodiment allows operating the LED circuit arrangement in a switch mode control, e.g. corresponding to the operation of a switched mode power supply (SMPS), such as a boost converter, providing a further enhanced and flexible control. According to the present embodiment, the first forward voltage of the LED light source in the low voltage mode, e.g. the overall forward voltage of the LED units, is lower than the operating voltage. Correspondingly, a voltage drop is present across the reactive element in this mode of operation, resulting in an increase in current. In the high voltage mode, the second forward voltage of the LED light source is higher than the operating voltage, resulting in a negative voltage across the reactive element, which e.g. may be a series inductance, as mentioned before. Accordingly, the current decreases. Since the reactive element, due to the energy storage behavior, tries to maintain the current level, the voltage, applied to the LED light source in the high voltage mode, is higher than the operating voltage, enabling a current flow through the LED light source. Thus, the circuit according to the present embodiment corresponds to a boost converting circuit.

Preferably, the switching means are adapted for a continuous operation, so that the LED units are continuously powered, i.e. connected with the reactive element in both switching modes. The present embodiment advantageously reduces optical flicker since both LED units are steadily supplied with power and thus continuously generate light. Furthermore, the switching frequency of the switching means advantageously can be increased, since the intrinsic capacitance of the LED units is not discharged completely.

According to a development of the invention, the switching means are adapted so that in said low forward voltage mode, said first and second LED units are connected in parallel to each other. Preferably, the switching means are further adapted to connect the first and second LED unit in series with each other in the high voltage mode. The present embodiment advantageously allows a further simplified circuit arrangement.

The parallel arrangement of the LED units provides a relatively low first forward voltage of the LED light source, which according to this embodiment substantially corresponds to the forward voltage of the parallel connection of said first and second LED unit. The second forward voltage of the LED light source in the high voltage mode, i.e. upon series connection of the LED units, corresponds substantially to the sum of the forward voltages of the first and second LED units. Thus, the present embodiment provides the aforementioned control of said low and high voltage modes with a further simplified circuit design and further advantageously enables a continuous operation to reduce optical flicker in the light output of the LED units.

The switching means may be provided to switch between said parallel and series operation according to any suitable design. Preferably, the switching means comprise at least two switching devices to connect the LED units either parallel to or in series with each other.

For example, the two switching devices in a first switching state may be provided to connect the LED units parallel to each other. The overall arrangement of first and second LED units in this case is connected in series with the reactive element and the voltage input, respectively. In a second state, the first and second LED units are connected in series with each other, e.g. over a suitable bridge circuit comprising a reverse voltage protection diode and/or a further switching device, such as a MOSFET. Also here, the series connection of the two LED units is connected in series with the reactive element.

As discussed above, in the case that the first and second LED units are connected in series with each other, the forward voltage of the LED light source corresponds to the sum of the forward voltages of the first and the second LED unit. The forward voltage of the first and the second LED unit may be chosen according to the application. To obtain a high quality light output for most applications, it is preferred that the forward voltage of said first LED unit substantially corresponds to the forward voltage of the second LED unit, which results in a particularly advantageous voltage ratio, e.g. close to 1:1. Certainly, it may be difficult to provide said first and second LED unit with identical forward voltages, in particular due to manufacturing tolerances of a typical mass manufacturing process. However, a deviation results in unequal current sharing in case said first and second LED units are connected parallel to each other, causing unequal stress for the LED units and unequal light generation. Therefore, the forward voltage of said first LED unit preferably is in a range of 90-110% of the forward voltage of said second LED unit.

The suitable voltage range may depend also on the forward characteristics of the LEDs used. The steeper the current-voltage curve of the LEDs, i.e. the LED units, the higher a possible current sharing "mismatch" might be for a given difference between the forward voltages. Therefore, alternatively or additionally to a forward voltage matching requirement, the LED units may be adapted for a defined forward voltage matching at a given voltage, e.g. set in accordance with the particular application. In such a case, at a given forward voltage, the current of the first LED unit should substantially correspond to the current of the second LED unit, e.g. in a range of 90-110% of the current of the second LED unit.

According to a development of the invention, the switching means are controlled by the control unit to have a switching frequency of 400 Hz to 40 MHz, preferably 16 kHz to 10 MHz and most preferably 20 kHz to 4 MHz. The present embodiment advantageously provides a further reduced optical flicker, enhancing the light output of the LED circuit arrangement.

Preferably, the control unit comprises current detection circuitry to determine the current through the LED light source. The current detection circuitry may be of any suitable type to enable reliable detection during the operation of the LED circuit arrangement. The current detection circuitry should provide a signal to the control unit, corresponding to the present current level of the current through the LED light source and/or the LED units during operation. The current detection circuitry may be formed integrally with said control unit, e.g. in a corresponding microcontroller, or may be provided separately and connected to the control unit over a suitable wired or wireless signaling connection. Preferably, the current detection circuitry comprises a current sensing resistor, connected in series with the first and the second LED unit, to provide a voltage signal to the control unit, which corresponds to the current through the LED units.

Most preferably, the control unit is operated with an auxiliary supply voltage, generated out of the voltages present in the LED light source during operation, such as the operating voltage or the forward voltage of either one of the LED units, via suitable circuitry, e.g. a decoupling diode, a filter capacitor and a linear voltage regulator. Generating the auxiliary supply voltage out of voltages already present in the LED light source is advantageous because then the LED light source does not need additional terminals to feed in an externally generated auxiliary supply voltage.

As discussed above, the light emitting diodes of the LED units are preferably formed on a common semiconductor die, substrate or module. In particular when high-power LEDs are used, several LEDs, i.e. pn-junctions, may be formed on a single die to provide the necessary luminous flux for lighting or general illumination applications. Accordingly, it is possible, particularly in the latter case, to form the first and the second LED unit on said common die.

According to a further development of the invention, the LED units, the switching means and/or the control unit are formed integrally with each other, e.g. on a single die or in a common package or module. The present embodiment allows a further reduction of the size of the inventive circuit arrangement, providing a highly compact setup.

The LED units, the switching means and/or the control unit may be provided on a single semiconductor die to provide a further simplified manufacturing process. Alternatively, an electric submount may be present to mechanically support and/or electrically connect the LED units, which submount comprises the switching means and/or the control unit. The submount may certainly comprise further electric or mechanical elements, such as e.g. a heat sink or heat pipe to dissipate heat generated by the LED units or the further electronic components of the LED light source.

It is further preferred that the reactive element is formed integrally with the LED light source, i.e. with the LED units, the switching means and/or the control unit. Most preferably, the reactive element is formed integrally with said electric submount.

According to a further preferred embodiment of the invention, the LED light source is a two-pole device. In terms of the present explanation, a two-pole or two-pin device is an electric component having two electric terminals for the connection to said LED circuit arrangement.

The present embodiment is particularly advantageous in terms of the mounting of the LED light source to a printed circuit board. Although, as discussed above, the LED light source comprises an internal current control, a user can integrate the device in the same way as a usual prior art LED light source into a PCB layout. The LED light source may thus be considered to have a "quasi-anode" and a "quasi-cathode".

According to a development of the invention, the LED circuit arrangement comprises more than one LED light source, connected in series with the voltage input. According to the present embodiment, the luminous flux of the inventive circuit arrangement can be further increased by a corresponding series connection of multiple LED light sources, as explained above. In particular, the present embodiment enables the use of a LED circuit arrangement with a single reactive element to which the multiple LED light sources are connected. Since the voltage input provides an operating voltage and the current is controlled by each LED light source internally, no further adaptation of the circuit is necessary. Certainly, however, in the case that a standard power supply is used and connected with the voltage input, the voltage, current and power rating should allow operation of the respective number of LED light sources. Additionally or alternatively, the LED circuit arrangement is preferably provided with one or more LEDs according to the prior art, connected in series with said one or more inventive LED light sources and said at least one reactive element. Such a combined circuit arrangement is particularly cost-efficient and simultaneously provides an increased luminous flux.

Furthermore, multiple LED circuit arrangements may be connected in parallel to said power supply to increase the luminous flux.

The switching frequency and thus the duty cycle of the switching mode operation mainly depends on the operating voltage. Since the current through the first and the second LED unit may differ in the low and high voltage modes, the luminous flux in both modes may differ, resulting in dependence of the luminous flux on the operating voltage. While this may be advantageous in that it enables the luminous flux to be easily set in a certain range, in particular in the case that a non-stabilized power supply is used, the quality of the light output may be impaired.

According to a further preferred embodiment of the invention, the control unit is configured to adapt the first and/or the second threshold value, so that the current through the LED light source corresponds to a predefined average lamp current. Since the luminous flux depends on the average lamp current, the present embodiment allows setting the luminous flux independently of the input voltage level, thus providing a further stabilized light output. The average lamp current may be set according to the application, e.g. by a user with a corresponding user interface and stored in a suitable memory or be factory set. Alternatively or additionally, the average lamp current may be variable and adapted by the control unit, e.g. using a feedback device provided to measure the output luminous flux and to set the average lamp current to a given set point flux. The present embodiment thus advantageously allows compensating e.g. for aging and temperature effects.

Preferably, the control unit is configured to determine the input voltage, e.g. using a voltage measurement circuit, and adapt the average lamp current accordingly. In this case, the control unit may be configured to set the average lamp current to provide a constant luminous flux, largely independently of the input voltage. Alternatively or additionally, the control unit may be configured to set the average lamp current according to a given relation with the input voltage. Accordingly, it is possible to set the luminous flux of the LED light source by controlling the input voltage, i.e. without the need of a further control signal or user interface. Most preferably, the control unit is configured to adapt the first, e.g. lower, current threshold value to provide the predefined average lamp current.

The LED light source according to the invention is adapted for operation with an LED circuit arrangement, as discussed above. The LED light source comprises a first and a second LED unit, each having at least one light emitting diode, controllable switching means to connect said LED units with a reactive element in a low voltage mode and a high voltage mode, and a control unit. In said low voltage mode, the LED light source shows a first forward voltage. In the high voltage mode, the LED light source shows a second forward voltage, higher than said first forward voltage.

The control unit is configured to set said switching means to said low voltage mode when a current, supplied by said voltage supply, corresponds to a first threshold value and to set said switching means to said high voltage mode when said supplied current corresponds to a second threshold value. Certainly, the LED light source may preferably be adapted to the above preferred embodiments.

According to the inventive method of operating an LED light source with an operating voltage, said LED light source comprises a first and a second LED unit, each having at least one light emitting diode, and controllable switching means to connect said LED units with a reactive element in a low voltage mode and a high voltage mode. In said low voltage mode, the LED light source shows a first forward voltage. In the high voltage mode, the LED light source shows a second forward voltage, higher than said first forward voltage. The switching means are set to said low voltage mode when an operating current, supplied to said LED light source, corresponds to a first threshold value and are set to said high voltage mode when said supplied current corresponds to a second threshold value. Certainly, the LED light source may preferably be operated using an LED circuit arrangement according to the above embodiments.

BRIEF DESCRIPTION OF THE DRAWINGS

The above and other objects, features and advantages of the present invention will become apparent from the description of preferred embodiments, in which.

DESCRIPTION OF EMBODIMENTS

Figure 1:
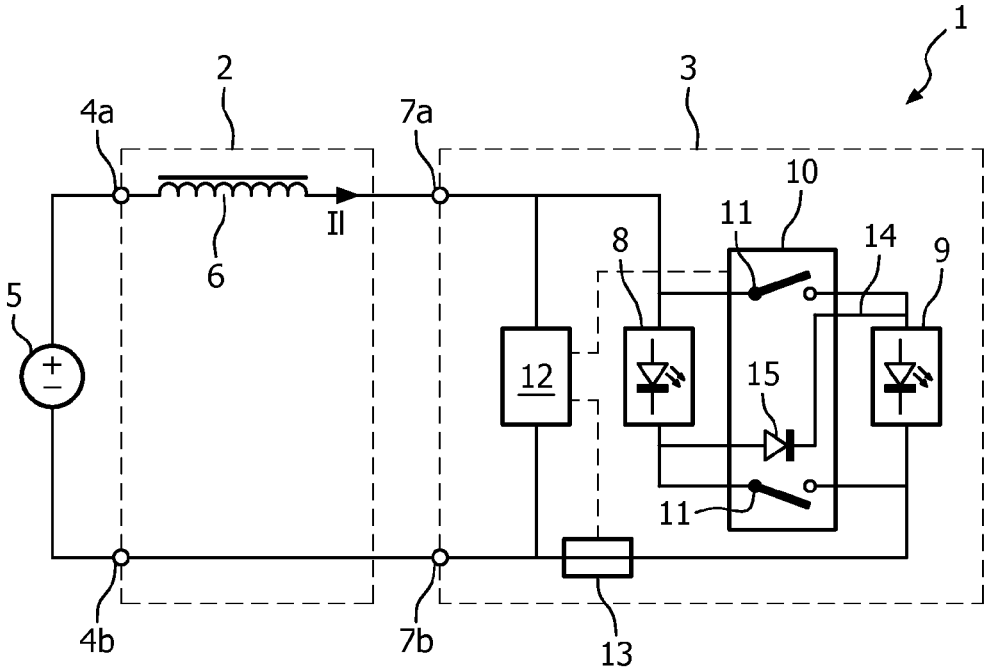
FIG. 1 shows a schematic circuit diagram of a LED circuit arrangement with a LED light source according to a first embodiment of the invention.

FIG. 1 shows a schematic circuit diagram of a LED circuit arrangement 1 according to a first embodiment of the present invention. The LED circuit arrangement 1 comprises a LED supply circuit 2 connected with a LED light source 3. The LED light source 3 is formed as a single module or chip, as will be explained in the following with reference to FIG. 2. The LED supply circuit 2 comprises a voltage input 4*a* and a voltage input 4*b*, ie. according to the present embodiment two terminals for connection to a voltage supply 5 providing a direct-current voltage of 15 V. The supply 5 may for example be a switching mode power supply unit connected to a corresponding mains line and including a rectifier to provide said direct-current voltage.

The LED supply circuit 2 further comprises a reactive element 6, i.e. in the present example a coil with an inductance of 100 μH, connected in series between the voltage input 4, and thus the voltage supply 5, and the LED light source 3.

The LED light source 3 comprises two terminals 7*a* and 7*b* for connection with the LED supply circuit 2. The LED light source 3 according to the present example thus may be referred to as "2-pole" or "2-pin" device, so that integration of the LED light source 3 into an existing supply circuit is easily possible. The terminals 7*a* and 7*b* according to the present embodiment are provided as metallic solder pads for connection to a printed circuit board, for example. The LED light source 3 further comprises a first LED unit 8 and a second LED unit 9, which according to the present example each comprise three high-power light emitting diodes 48 (not shown in FIG. 1) arranged in series, resulting in a defined forward voltage of approximately 9 V. To connect the first and the second LED unit 8, 9 with the reactive element 6 and thus with voltage supply 5, switching means 10 are provided, comprising, according to the present embodiment, two controllable switches 11. The switches 11 are operated by a control unit 12 over a suitable control connection, indicated by the dotted line in FIG. 1. According to the present example, the control unit 12 comprises a microcontroller suitably programmed for current control, as discussed in the following. The control unit 12 is further connected with current detector 13 to measure the current through the circuit arrangement 1. The switching means 10 are provided to operate the LED light source 1 in a high voltage mode and a low voltage mode.

In the high voltage mode, switches 11 are open, as shown in FIG. 1. The first and the second LED unit 8, 9 are accordingly connected in series with each other and the reactive element 6 over bridge circuit 14 comprising a reverse voltage protection diode 15, resulting in a defined first overall forward voltage of the LED light source 3. In the low voltage mode, both switches 11 are closed, so that the first and the second LED unit 8, 9 are connected parallel to each other, resulting in a defined second forward voltage of the LED light source 3. In this mode, the reverse voltage protection diode 15 prevents a short circuit. The LED light source 3 thus can be set in two modes. The overall forward voltage of the LED light source 3 and thus the LED units 8, 9, e.g. measured between the two terminals 7*a* and 7*b*, can accordingly be set to a first forward voltage of the LED light source of 9 V in the low voltage mode and a second forward voltage of the LED light source 3 of 18 V in the high voltage mode. Accordingly, the overall forward voltage of the LED light source 3 in the low voltage mode is lower than the voltage of voltage supply 5. In the high voltage mode, the forward voltage is higher than the supplied voltage.

The principle of operation of the inventive LED circuit arrangement 1 according to the embodiment of FIG. 1 is hereinafter explained with reference to the timing diagram of FIG. 2. In the figure, the current $I_L$ through reactive element 6 and thus through terminals 7*a* and 7*b* of the LED light source 3 and the current $I_{JUNC}$ are shown over time, starting with the connection of the LED circuit arrangement 1 to power, i.e. to voltage supply 5.

Current $I_{JUNC}$ refers to the effective current per junction of the LED of each LED unit 8, 9. Depending on the LED light source 3 being in the low or the high voltage mode 33, the current $I_L$ flows through the two LED units 8 and 9 in parallel or in series, respectively. Hence, the effective current $I_{JUNC}$ per LED unit 8, 9 corresponds to the current $I_L$ in the high voltage mode 33 and to half of the current $I_L$ in the low voltage mode 32 since here, the two LED units 8, 9 are connected in parallel, so that the current $I_L$ is shared. According to the present example, the LED units 8, 9 are assumed to show corresponding electrical characteristics, i.e. the voltage ratio of the forward voltage of the LED units 8, 9 is 1:1. Thus, the current $I_L$ is shared equally. As mentioned above, the control unit 12 is adapted to measure the current $I_L$ through the LED light source 3, using current detector 13. The control unit 12 is adapted to control the switches 11 of switching means 10 from said low voltage mode, i.e. the parallel connection, to said series connection. The control unit 12 is programmed with a first current threshold value 30 of, according to the present example, 700 mA and a second current threshold value 31 of 1400 mA, i.e. higher than the first threshold 30 by "current ripple" Δi of 700 mA. When the measured current is lower than or corresponds to said first threshold value 30, the control unit 12 controls the switching means 10 to operate in the low voltage mode 32. Even if the current $I_L$ further increases, the switching means 10 remain in the low voltage mode. In case the current reaches, i.e. is equal to or higher than, said second threshold value 31, the switching means 10 are controlled to operate in the high voltage mode 33. Again, the switching means 10 are kept in the high voltage mode 33 until the current $I_L$ is equal to or lower than the first threshold value 30. Thus, use can suitably be made of the current control according to the invention, which enables keeping the current $I_L$ in the operational states, i.e. under normal operating conditions, between the first and second threshold values. The present example results in a switching frequency of approximately 30 kHz.

The duty cycle or switching frequency of the switching means 10 certainly depends on the threshold values 30, 31, and thus on the current ripple Δi, the inductance of the reactive element 6 and the characteristics, i.e. particularly the forward voltages, of the LED units 8, 9. To provide a switching frequency in the range of 20 kHz to 4 MHz with the threshold values mentioned before, an inductance of approximately 150 μH to 750 nH is particularly preferred.

The operation of the set-up thus corresponds substantially to the operation of a step-up converter, so that a duty cycle or switching frequency may be set according to the respective application by an expert, skilled in the art, using known design criteria and formulas.

Figure 2:
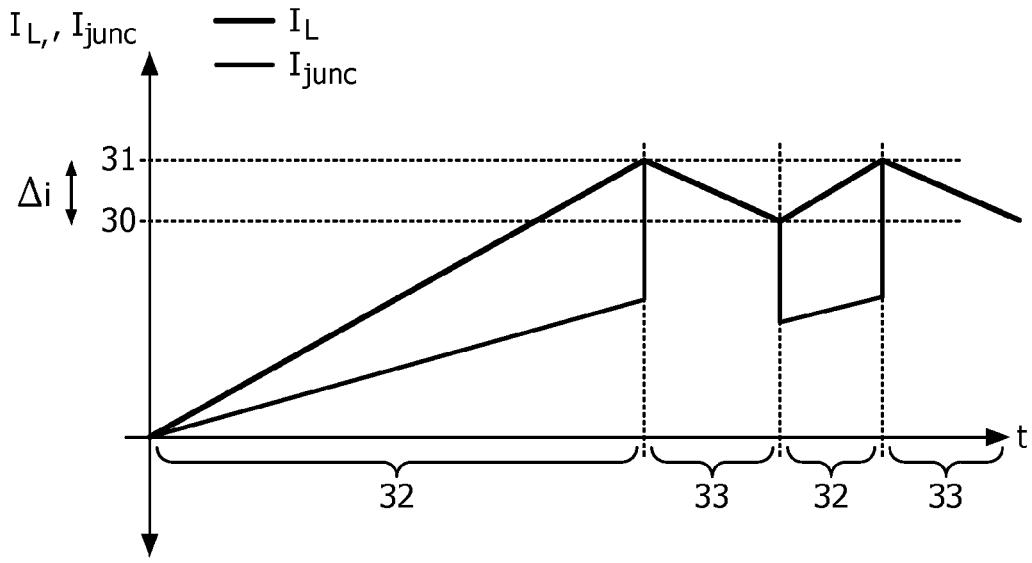
FIG. 2 shows a timing diagram of the current in the LED circuit arrangement according to FIG. 1 during operation.

Referring to FIG. 2, the operation of the control unit 12 is initiated by the connection of the circuit 1 to the voltage supply 5. Initially, the control unit 12 sets the switching means 10 to the low voltage mode 32. Current $I_L$ will be zero, accordingly. Because in the low voltage mode 32, the effective overall forward voltage of the LED light source 3 is lower than the operating voltage of voltage supply 5, as discussed above, a voltage drop across reactive element 6 is present. Accordingly, current $I_L$ increases during low voltage mode/phase 32.

When the current $I_L$ reaches the second threshold value 31, the control unit 12 sets the switches 11 of the switching means 10 to the open state, i.e. the high voltage mode/phase 33. The overall forward voltage of the LED units 8, 9 in this mode is higher than the voltage of the voltage supply 5 due to the series connection. However, since the reactive element 6 will try to resist changes of $I_L$, the voltage at the terminals 7 of the LED light source 3 increases to a level where the current flow through the series connection of the first LED unit 8, second LED unit 9 and reverse voltage protection diode 15 is possible. The increase in voltage occurs at the same time as the turn off procedure of the switching means 10, resulting in a continuous current flow and thus a continuous operation of the LEDs of the first and second LED units 8, 9.

Since the overall forward voltage according to the present high voltage mode 33 is higher than the operating voltage of voltage supply 5, the voltage across the reactive element 6 is negative, resulting in a decrease of the current $I_L$ in the high voltage mode 33, as shown in FIG. 2. When the current $I_L$ reaches the first threshold value 30, the control unit 12 controls the switches 11 of switching means 10 again to operate in the low voltage mode 32, i.e. the mode of parallel operation of the first and the second LED unit 8, 9. Accordingly, the current $I_L$ increases in the subsequent low voltage mode 32 and the operation discussed above is repeated. The operation of the control unit 12 of LED light source 3 thus provides current control within the two threshold values 30, 31 and thus allows operation of the LED light source 3 with a voltage supply 5, while stabilizing the current. Thus, an elaborate current regulator can be advantageously omitted. In addition, the LEDs 48 of LED units 8, 9 are continuously provided with operating current, resulting in a light output without dark time and substantially flicker-free, due to the high switching frequency. When the circuit arrangement 1 is operated with a voltage higher than the overall forward voltage of the LED light source 3 in the high voltage mode 33, the internal current regulation is not active. Instead, the LED light source 3 then may be operated like a typical string of LEDs 48, where the current needs to be controlled externally. Accordingly, the same light source 3, which operates as a self-controlling device within a certain supply voltage range, can be operated as a normal high voltage LED light source 3 when exposed to a supply voltage higher than the overall forward voltage in the high voltage mode 33. Here, a current-limiting device should be provided externally. The LED light source 3 and the circuit arrangement 1 thus are highly versatile. Certainly, the electrical characteristics as well as the current threshold values should be adapted according to the respective application and particularly with regard to the supplied voltage and the specific electrical components used. However, such adaptation may be conducted by the expert with ordinary skill.

Figure 3A:
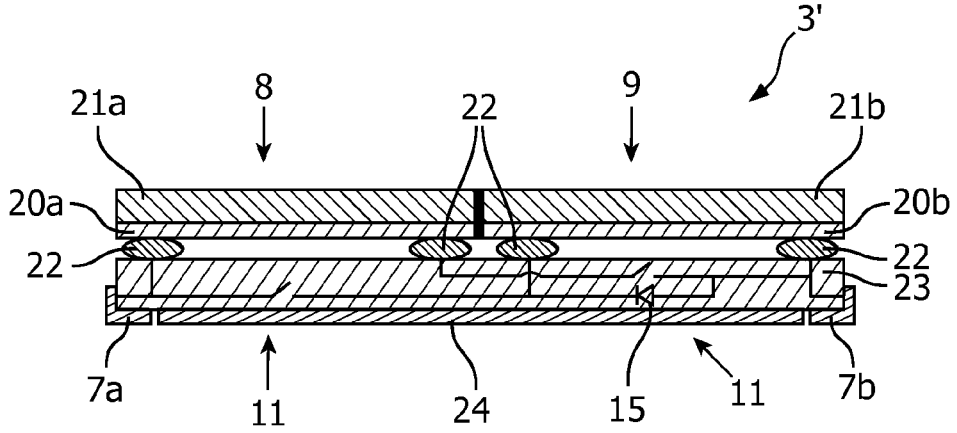
FIG. 3*a* shows a cross sectional view of a LED light source according to a second embodiment.

As discussed above, the LED light source 3 may be formed as an integrated module, thus having an advantageously small form factor. FIG. 3*a* shows an embodiment of a light source 3' in a cross sectional view corresponding substantially to the embodiment of FIG. 1. As shown, the first and the second LED unit 8, 9 each are formed from an epitaxial semiconductor layer 20*a*, 20*b* as known in the art, comprising the diode semiconductor structures. To provide a white light output, phosphor layer 21*a*, 21*b* is provided on top of the epitaxial semiconductor layer 20*a*, 20*b*. The above mentioned layers 20*a*, 20*b*, 21*a*, 21*b* of the LED light source module 3' are formed in a standard semiconductor manufacturing process, allowing a cost-efficient setup. The semiconductor layer 20*a*, 20*b* is connected to an electric submount 23 via solder joints 22 to provide the necessary electrical connections and mechanical fixation.

Figure 3B:
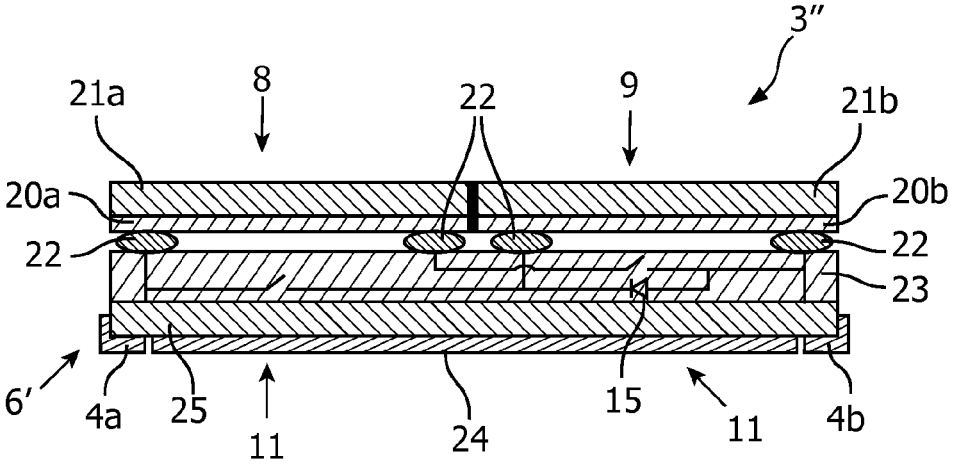
FIG. 3*b* shows a cross-sectional view of a LED light source according to a third embodiment.

The electric submount 23 comprises, as indicated in FIG. 3*a*, the remaining electric components of the LED light source module 3' shown in FIG. 1, namely the switching means 10, the control unit 12, the current detector 13 and the bridge circuit 14 with the reverse voltage protection diode 15. For reasons of clarity, not all of the aforementioned components are shown in FIG. 3*a*. The electric submount 23 is also formed by a standard, known semiconductor ceramic or printed circuit board manufacturing process. The overall arrangement is connectable to the LED supply circuit 2 (not shown in FIG. 3*a*) over corresponding solder terminals 7*a* and 7*b*. A heat sink interface 24 is provided to dissipate heat, generated by the LED units 8, 9 and the electric submount 23. FIG. 3*b* shows a further embodiment of an LED light source 3".

The embodiment of FIG. 3*b* corresponds substantially to the embodiment of FIG. 3*a* with the exception of a further inductive layer 25, which serves as reactive element 6'. Accordingly, the LED light source 3" provides an even further integrated set-up, so that the LED light source 3" is easily connectable to voltage supply 5 over voltage input 4*a* and 4*b*.

Figure 3C:
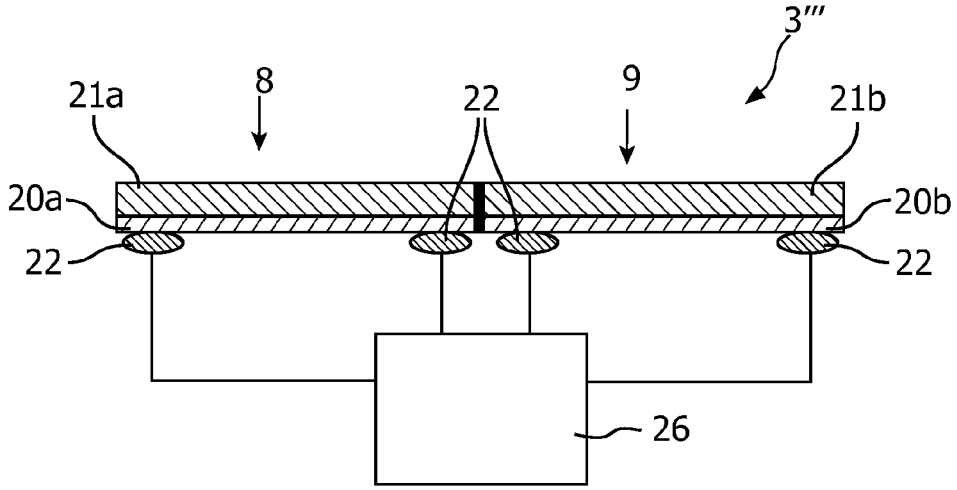
FIG. 3*c* shows a cross-sectional view of a LED light source according to a fourth embodiment.

FIG. 3*c* shows a further embodiment of the inventive LED light source 3'". The embodiment of FIG. 3*c* corresponds substantially to the embodiment of FIG. 3*a*, with the exception that here no electric submount 23 is present. Accordingly, the first and second LED units 8, 9 are connected via solder joints 22 to a printed circuit board 26 comprising the aforementioned further components of the LED light source 3'", i.e. controllable switching means 10, control unit 12, current detector 13 and bridge circuit 14 (not shown in FIG. 3*c*).

Figure 4:
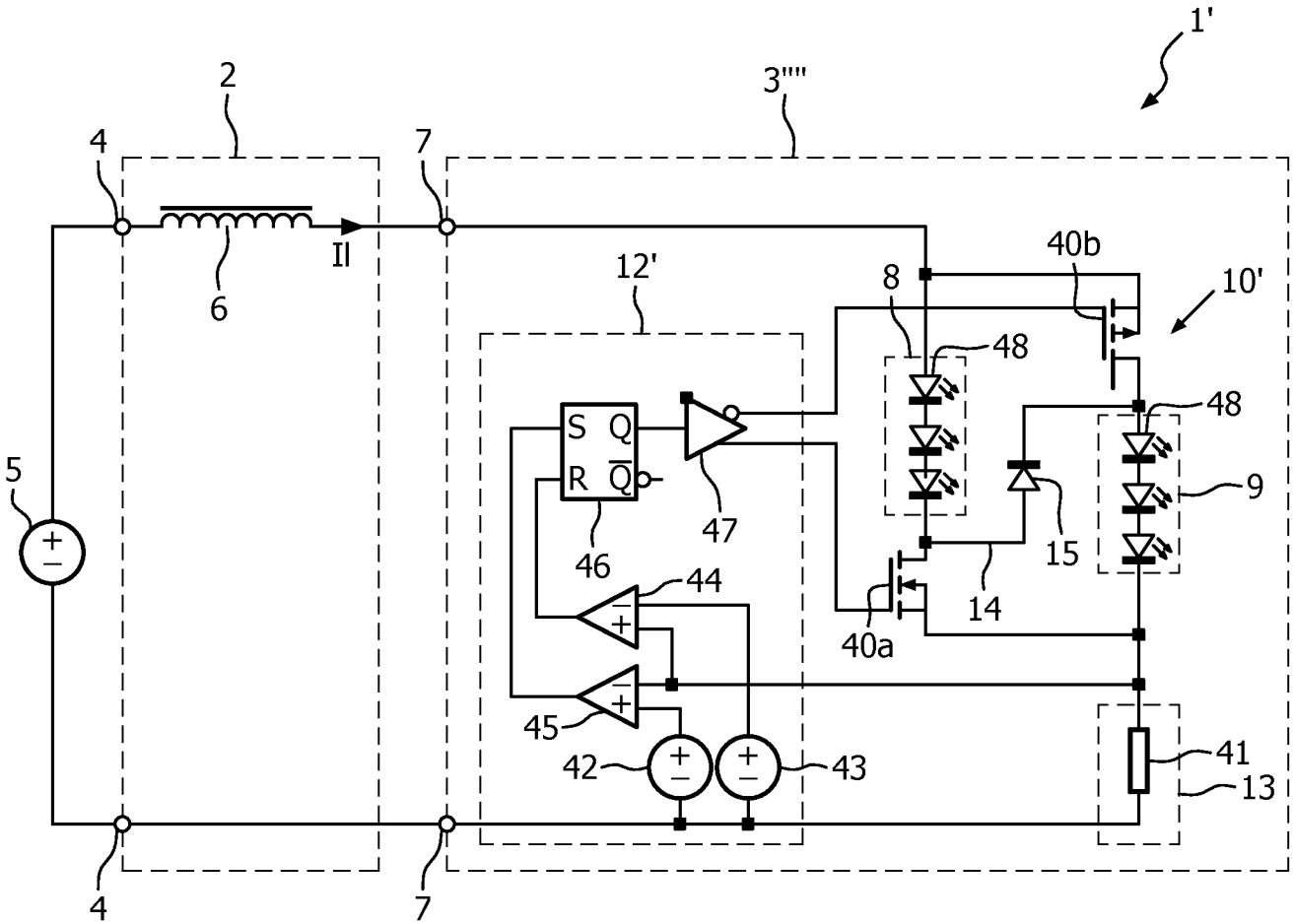
FIG. 4 shows a schematic circuit diagram of the LED circuit arrangement according to a further embodiment of the invention and FIG. 5 shows a schematic circuit diagram of the LED circuit arrangement according to a further embodiment of the invention.

FIG. 4 shows a schematic circuit diagram of a LED circuit arrangement 1' according to a further embodiment.

The embodiment of circuit arrangement 1' according to FIG. 4 substantially corresponds to the embodiment explained above with reference to FIG. 1, with the exception of modified switching means 10' and control unit 12'. The switching means 10' according to the present example comprises two MOSFETs 40*a* and 40*b*, controlled by a control unit 12'. The control unit 12' according to the embodiment of FIG. 4 comprises a flip-flop device 46, output Q of which is connected to gate driver 47. The gate driver 47 serves to amplify the signal of flip-flop device 46 to a level suitable for driving the gate of MOSFETs 40. According to the present example, MOSFET 40*a* is of the N-channel type, while MOSFET 40*b* is of the P-channel type. Depending on the specific type of MOSFET 40*a*, 40*b* used, level shifting might not be necessary to drive the P-channel MOSFET 40*b*, i.e. if the high forward voltage is lower than the allowed gate-source voltage of the P-channel MOSFET 40*b*. Multiple concepts and driver ICs for MOSFET gate driving exist in the art. For the aforementioned integrated device, a suitable circuit is realized on submount 23, considering the input characteristics of MOSFETs 40, the voltage levels and the expected switching frequency. Control unit 12' furthermore comprises a first comparator 44 and a second comparator 45 connected to a first voltage reference generator 42 and second voltage reference generator 43, respectively.

The comparators 44, 45 compare the voltage levels delivered to their input connections. If the voltage at the respective non-inverting input (marked with a "+" sign in FIG. 4) is higher than the voltage at the respective other, inverting input, the output signal to flip-flop device 46 is high. Accordingly, the output signal is low if the voltage at the non-inverting input is lower than the voltage at the inverting input. The comparators 44, 45 should exhibit a proper common mode voltage range to allow the desired switching operation. For high efficiency, the voltage drop across sensing resistor 41 should be quite small, e.g. lower than 100 mV. Hence, the comparators 44, 45 have to operate with an input signal close to the ground potential, which may be provided as the most negative supply voltage. Multiple types of comparators for the present application are available on the market, typically referred to as "single supply" or even "rail-to-rail input" comparators. Most simply, a suitable differential amplifier might be used as a comparator.

The voltage reference generator 42 may comprise individual biased zener diodes, bandgap references or simple voltage dividers powered from a common auxiliary supply of a suitable voltage level and stability.

The first and second comparator 44, 45 are connected with current detector 13, which, according to the present example, comprises a current sensing resistor 41. The resistor 41 provides a voltage to the first and second comparators 44, 45, corresponding to the present current through the lamp 3''''. Comparators 44, 45 compare the signal with the reference voltages supplied by said first and second voltage reference generator 42, 43, which are set to correspond to the first and second current threshold values 30, 31. During the start-up phase, upon initialization of the device, the comparator 45 generates a high signal, setting the flip-flop device 46. The output Q of flip-flop 46 accordingly is high, causing the MOSFETs 40 to be in the closed state. The LED light source 3'''' thus is set to the low voltage mode. When the voltage drop across resistor 41 reaches the first threshold value 30, comparator 45 generates a low output signal, but due to the flip-flop device 46, the switches will stay in the closed state. When the voltage drop across resistor 41 reaches the second threshold value 31, i.e. the voltage set by the second voltage reference generator 43, comparator 44 generates a high output signal, resetting the flip-flop device 46, so that the MOSFETs 40 are deactivated, i.e. set to the opened state. The LED light source 3'''' thus is set to the high voltage mode, resulting in a decrease of the current $I_L$, as discussed above with reference to FIG. 2. The embodiment according to FIG. 4 provides a simple and thus cost efficient setup of the LED light source 3''''. As discussed above, the first and second current threshold values 30, 31 are set by the corresponding first and second voltage reference generator 42, 43. Although in both modes, i.e. the low voltage mode and the high voltage mode, both LED units 8, 9 (each comprising single LEDs 48) are continuously provided with an operating current, the luminous flux in both modes certainly differs due to the switching from a parallel connection to a series connection of LED unit 8, 9. Therefore, the luminous flux of the LED unit 8, 9 depends on the duty cycle of the control and thus at least to some extent on the voltage of voltage supply 5; while it may be advantageous to be able to control the luminous flux by a variation of the operating voltage between the high and low forward voltages, the dependency may be undesirable for operating circuit 1' with a not sufficiently stabilized voltage source 5.

Figure 5:
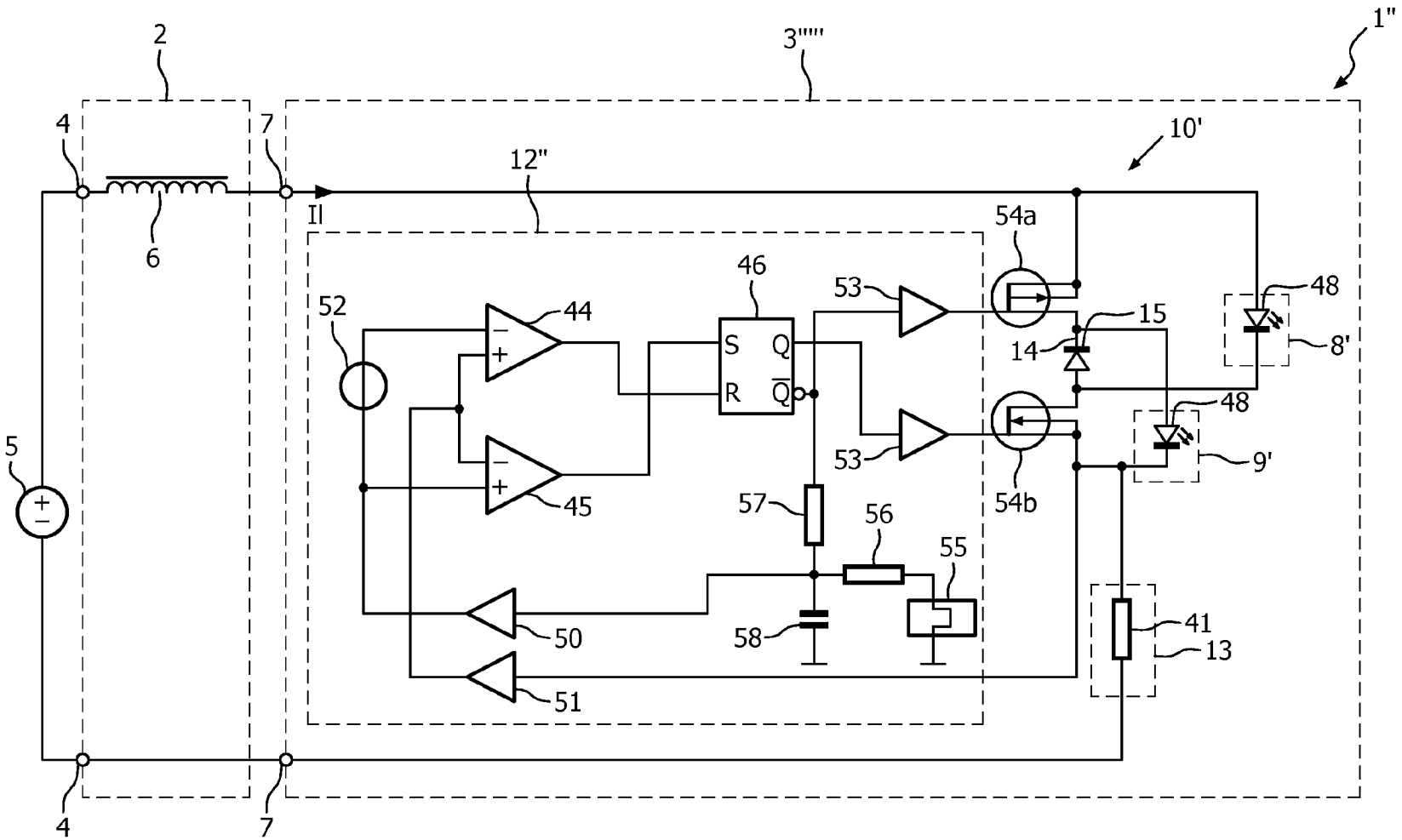

FIG. 5 shows a schematic circuit diagram of an LED circuit arrangement 1'' according to a further embodiment of the invention. The embodiment of FIG. 5 substantially corresponds to the embodiment explained above with reference to FIG. 4, with the exception of control unit 12'' and first and second LED units 8', 9'. With reference to FIG. 5, the first and second LED unit 8', 9' each only comprise a single LED 48. The control unit 12'' comprises a further voltage source 52 determining the difference between the first and second threshold values 30, 31 and hence determining the current ripple Δi of the current $I_L$ through the reactive element 6. A first OP-AMP 50 sets the first and second current threshold values 30 and 31. These are no longer constant, as the input of first OP-AMP 50 is connected to the arrangement of capacitor 58, resistor 56, 57 and the inverting output of flip-flop device 46, so that the first current threshold value 30 mainly depends on the duty cycle. A thermal fuse 55 of the switching operation provides over-temperature protection. A second OP-AMP 51 is connected with resistor 41 to provide a signal, corresponding to the present current through LED light source 1'', as discussed above. In correspondence with the embodiment of FIG. 4, gate drivers 53, e.g. OP-AMPs, serve to amplify the signals of flip-flop device 46 to a level suitable for driving the gate of MOSFETs 54*a* and 54*b*. The inverting output of flip-flop device 46 is connected to a first gate driver 53 and the output Q of flip-flop device 46 is connected to a second gate driver 53.

According to the present embodiment, the first and second current threshold values 30, 31 are variable and dependent on the duty cycle of the switching operation, so that the output luminous flux is linearly dependent on the input voltage of voltage supply 5, thereby enabling dimming capabilities without additional control means. The RC-circuit, formed by resistor 57 and capacitor 58, filters out any high frequency component of the duty cycles of the MOSFETs 54*a* and 54*b*, so that the average value is used to set the first and second current thresholds 30, 31. When the temperature of the LED circuit arrangement 1'' reaches an upper limit, thermal fuse 55 clamps the duty cycle signal to a low value, so that the average inductor current $I_L$ will be low to drive the LEDs 48 with a low or zero power level.

The duty cycle of the switches 54*a* and 54*b* is defined as $$d_K = \frac{T_{up}}{T_S} = \frac{K}{K-1}\left(1 - \frac{V}{Vf_{high}}\right),$$

where $V_{supply}$ is the voltage, applied to terminals 7 of the LED light source 3'''' and $Vf_{high}$ is the overall forward voltage of the LED light source 3'''' in the high voltage mode 33. Time $T_{up}$ is the charging-up time of reactive element 6, time $T_S$ depicts the switching periods, and $$K = \frac{Vf_{high}}{Vf_{low}} > 1,$$

where $Vf_{low}$ is the overall forward voltage of the LED light source 3'''' in the low voltage mode 32.

For the particular case of the above embodiment, it follows that $$d_2 = 2 \cdot \left(1 - \frac{V_{supply}}{Vf_{high}}\right).$$

The switching frequency can be expressed as $$F_S = \frac{V_{supply} - Vf_{low}}{L_1} - \frac{d_K}{\Delta I},$$

where Δi is the current ripple amplitude of reactive element 6.

In the case of K=2, and assuming that the LED forward voltages do not vary in steady-state operation, the total average power delivered to the LEDs 48 may be computed as $$P_{LED} = \left(1 - \frac{d_2}{2}\right) \cdot Vf_{high} \cdot I_{av0}$$

where $I_{av0}$ is the average inductor current of reactive element 6, which according to the embodiment described above, is independent of $V_{supply}$ and equal to $$I_{av0} = I_{L1min} + \frac{\Delta I}{2},$$

where $I_{L1min}$ is the minimum value of the inductor current waveform in steady state.

From the above expressions, it can be seen that the average power delivered to the LEDs 48 varies linearly with $V_{supply}$. The maximum power span corresponds to 0.5 $P_{max}$. The maximum power delivery $P_{max}$ is achieved as $V_{supply}$ approaches $Vf_{high}$. Accordingly, the minimum power $P_{min}$ is attained as $V_{supply}$ approaches $Vf_{low}$.

According to FIG. 5, the voltage source 52 defines current ripple ΔI, whereas OP-AMP 50 sets $I_{L1min}$. The latter is no longer constant, as the input of OP-AMP 50 corresponds to $1-D_2$. Thus, OP-AMP 50 produces an output signal such that $$I_{L1min}(d) = I_{L1min0} + m_x(1-d),$$

where $I_{L1min0}$ and $m_x$ are defined by the settings of the voltage source 52. The average output current in the present configuration thus is $$P'_{LED} = \left(I_{L1min}(d) + \frac{\Delta I}{2}\right)\left(1 - \frac{d_2}{2}\right) \cdot Vf_{high}.$$

The invention has been illustrated and described in detail in the drawings and the forward going description. Such illustration and description are to be considered illustrative or exemplary and not restrictive; the invention is not limited to the disclosed embodiments. It may for example be possible to operate the invention according to an embodiment in which:

- the LED units 8, 9 comprise a higher or lower number of light emitting diodes 48, connected in series or in parallel or a combination thereof,
- the LED units 8, 9 comprise OLEDs or laser diodes as light emitting elements,
- the reactive element 6 is integrated with the LED light source module 3, 3', 3", 3''', 3'''', 3''''',
- in the circuit arrangements 1, 1', 1", multiple LED light sources 3, 3', 3", 3''', 3'''', 3''''' are connected in series to reactive element 6,
- voltage supply 5 is integrated with LED supply circuit 2,
- terminals 7*a* and 7*b*, instead of being provided as wire bond pads or solder pads, are provided as connecting pins of e.g. one or more lamp caps, and/or
- the control unit 12, 12', 12" may be configured with a mode switch, which is arranged to set the control unit 12, 12', 12" to a defined control setting. This may be performed via the normal terminals 7, e.g. by means of activating, for example ramping up, the supplied signal in a special mode. Then, the switching means 10 are activated or deactivated and the LED light source 3, 3', 3", 3''', 3'''', 3''''' can be operated with either the low or the high mode voltage. Depending on the realization of the mode switch in the LED light source 3, 3', 3"3''', 3'''', 3''''', this setting may be non-volatile (permanently stored in the LED light source), volatile (valid as long as supply voltage is present at terminals 7, but lost after power down) or dynamic (valid only for a limited time after commanding, so that the setting has to be refreshed from time to time to stay in the desired control mode, otherwise the LED light source 3, 3', 3", 3''', 3'''', 3''''' enters the normal internal control mode, as mentioned above).

In the claims, the word "comprising" does not exclude other elements or steps, and the indefinite article "a" or "an" does not exclude a plurality. The mere fact that certain measures are recited in mutually different dependent claims or embodiments does not indicate that a combination of these measures cannot be used to advantage. Any reference signs in the claims should not be construed as limiting the scope thereof.

The invention claimed is:

1. An LED circuit arrangement, comprising a DC voltage input, adapted to provide an operating voltage, a reactive element, connected in series with said DC voltage input, and an LED light source comprising a first and a second LED unit, each having at least one light emitting diode, in a low voltage mode of the LED light source, said first and second LED units being connected parallel to each other, and in a high voltage mode of the LED light source, said first and second LED units being connected in series with each other, a controllable switching means to switch the LED light source between the low voltage mode and the high voltage mode, and a control unit, configured to set said switching means to said low voltage mode when an operating current, supplied to said LED light source, corresponds to a first threshold value, and to set said switching means to said high voltage mode when said supplied current corresponds to a second threshold value.

2. The LED circuit arrangement according to claim 1, wherein the first forward voltage of said LED light source is lower than said operating voltage and the second forward voltage of said LED light source is higher than said operating voltage.

3. The LED circuit arrangement of claim 2, wherein the LED units are connected with said reactive element in both said low voltage mode and said high voltage mode.

4. The LED circuit arrangement according to claim 2, wherein said switching means are controlled by said control unit with a switching frequency of 400 Hz to 40 MHz.

5. The LED circuit arrangement according to claim 2, wherein said control unit comprises current detection circuitry to determine the current through the LED light source.

6. The LED circuit arrangement according to claim 2, wherein said LED units, said switching means and/or said control unit are formed integrally with each other.

7. The LED circuit arrangement according to claim 1, wherein the LED units are connected with said reactive element in both said low voltage mode and said high voltage mode.

8. The LED circuit arrangement according to claim 7, wherein said switching means are controlled by said control unit with a switching frequency of 400 Hz to 40 MHz.

9. The LED circuit arrangement according to claim 7, wherein said control unit comprises current detection circuitry to determine the current through the LED light source.

10. The LED circuit arrangement according to claim 1, wherein the forward voltage of said first LED unit substantially corresponds to the forward voltage of said second LED unit.

11. The LED circuit arrangement according to claim 10, wherein said switching means are controlled by said control unit with a switching frequency of 400 Hz to 40 MHz.

12. The LED circuit arrangement according to claim 11, wherein said control unit comprises current detection circuitry to determine the current through the LED light source.

13. The LED circuit arrangement according to claim 10, wherein said control unit comprises current detection circuitry to determine the current through the LED light source.

14. The LED circuit arrangement according to claim 1, wherein said switching means are controlled by said control unit with a switching frequency of 400 Hz to 40 MHz.

15. The LED circuit arrangement according to claim 1, wherein said control unit comprises current detection circuitry to determine the current through the LED light source.

16. The LED circuit arrangement according to claim 15, wherein the control unit is configured to adapt the first and/or second threshold values so that the current through the LED light source corresponds to a predefined average lamp current.

17. The LED circuit arrangement according to claim 15, wherein said LED units, said switching means and/or said control unit are formed integrally with each other.

18. The LED circuit arrangement according to claim 15, wherein said reactive element is formed integrally with said LED light source.

19. The LED circuit arrangement according to claim 15, wherein said LED light source is a two-pole device.

20. The LED circuit arrangement according to claim 15, comprising more than one LED light source, connected in series with said voltage input.

* * * * *